US009180666B2

(12) United States Patent
Wanibe et al.

(10) Patent No.: US 9,180,666 B2
(45) Date of Patent: Nov. 10, 2015

(54) IMAGE RECORDING DEVICE

(71) Applicant: SEIKO EPSON CORPORATION, Tokyo (JP)

(72) Inventors: Akihisa Wanibe, Matsumoto (JP); Teruo Nakayama, Suwa (JP); Koji Kitazawa, Shiojii (JP); Masahiko Tsuyuki, Chino (JP)

(73) Assignee: Seiko Epson Coporation, Tokyo (JP)

( * ) Notice: Subject to any disclaimer, the term of this patent is extended or adjusted under 35 U.S.C. 154(b) by 0 days.

(21) Appl. No.: 14/223,257

(22) Filed: Mar. 24, 2014

(65) Prior Publication Data

US 2014/0292858 A1 Oct. 2, 2014

(30) Foreign Application Priority Data

Mar. 27, 2013 (JP) ..... 2013-065783

(51) Int. Cl.

| | |
|---|---|
| ***B41J 2/05*** | (2006.01) |
| ***B41J 2/14*** | (2006.01) |
| ***B41J 2/175*** | (2006.01) |
| ***B41J 2/35*** | (2006.01) |
| ***B41J 2/155*** | (2006.01) |

(52) U.S. Cl.

CPC ..... *B41J 2/14072* (2013.01); *B41J 2/14* (2013.01); *B41J 2/155* (2013.01); *B41J 2/1752* (2013.01); *B41J 2/17526* (2013.01); *B41J 2/35* (2013.01); *B41J 2002/14362* (2013.01); *B41J 2202/20* (2013.01)

(58) Field of Classification Search

CPC ..... B41J 2/14072; B41J 2/17526; B41J 2/35

See application file for complete search history.

(56) References Cited

U.S. PATENT DOCUMENTS 5,245,361 A * 9/1993 Kashimura et al. ..... 347/87

FOREIGN PATENT DOCUMENTS

JP 2009-285840 12/2009

* cited by examiner

*Primary Examiner* — Julian Huffman

(74) *Attorney, Agent, or Firm* — Workman Nydegger

(57) ABSTRACT

An image recording device includes a head unit having a print head and a first substrate, a second substrate provided separate to the head unit, a support member that supports the head unit and the second substrate while a first positional relationship in which the head unit and the second substrate are close to each other and a second positional relationship in which the head unit and the second substrate are away from each other are changed. Moreover, in the first positional relationship, the head unit and the second substrate are connected to each other to form an electric signal supply path from the second substrate to the head unit, and, conversely, in the second positional relationship, the connection between the head unit and the second substrate is released such that the head unit is dismountable from the support member.

12 Claims, 6 Drawing Sheets

IMAGE RECORDING DEVICE

BACKGROUND

1. Technical Field

The present invention relates to a technique for appropriately configuring a circuit substrate that is used to control a print head.

2. Related Art

Hitherto, image recording devices such as ink jet printers that perform image recording by ejecting a liquid from a print head onto a recording medium are provided with an electric circuit that is used to control the print head. In particular, in JP-A-2009-285840, a circuit substrate, on which a drive circuit serving as the above electric circuit is mounted, and a print head are integrally formed and fixed on a common support member.

As described above, when the substrate, which is needed to control the print head, and the print head are fixed on a common support member, the substrate and the print head can be arranged relatively close to each other. Accordingly, a signal path from the substrate to the print head becomes shorter and an advantage is obtained in that degradation of electric signals transmitted through the signal path can be suppressed. However, even though the above advantage is obtained, the print head disadvantageously lacks ease of maintenance. In other words, because the substrate and the print head are fixed on a common support member, when replacing the print head due to its product life or the like, there are cases in which the substrate that is fixed to the support member together with the print head is disadvantageously replaced as well. However, the print head and the substrate do not necessarily have to be replaced at the same time; accordingly, the configuration described above in which the print head and the substrate are replaced together is uneconomical.

In order to deal with the above disadvantage, at least a portion of the circuit that controls the print head can be devised to be mounted on a substrate that is separate to the print head. This will allow the print head to be replaced at a timing suitable for the print head independently from the substrate that has been separated from the print head. However, when the substrate is provided separate to the print head, the signal path from the substrate to the print head becomes long and the electric signal is disadvantageously degraded.

As described above, when the substrate is supported together with the print head by a common support member, a decrease in the ease of maintenance disadvantageously occurs, and, on the other hand, when the substrate is provided separate to the print head, degradation of the electric signal occurs. Therefore, a substrate configuration that overcomes these problems is required.

SUMMARY

An advantage of some aspects of the invention is that a technique is provided that can improve both the ease of maintenance of the substrate used to control the print head and the suppression of signal degradation.

In order to achieve the above advantage, an image recording device according to an aspect of the invention includes a head unit including a print head that performs image recording by ejecting a liquid onto a recording medium and a first substrate that supplies an electric signal that is used to control the print head to the print head; a second substrate that is provided separate to the head unit, the second substrate supplying an electric signal used to control the print head to the head unit; and a support member that supports the head unit and the second substrate while allowing a positional relationship between the head unit and the second substrate to be changed between a first positional relationship in which the head unit and the second substrate are close to each other and a second positional relationship in which the head unit and the second substrate are away from each other. In the image recording device, while the head unit and the second substrate are in the first positional relationship and are supported by the support member, the head unit and the second substrate are connected together such that an electric signal supply path is formed from the second substrate to the head unit, and while the head unit and the second substrate are in the second positional relationship and are supported by the support member, the head unit and the second substrate are disconnected from each other and the head unit is dismountable from the support member.

The image recording device according to the aspect of the invention is provided with the first substrate and the second substrate serving as substrates that supplies electric signals used to control the print head. The first substrate is integrally provided together with the print head so as to constitute the head unit and, conversely, the second substrate is provided separate to the head unit. Moreover, the support member that supports the head unit and the second substrate can change its supporting state between the first positional relationship in which the head unit and the second substrate are close to each other and the second positional relationship in which the head unit and the second substrate are away from each other. Specifically, while the head unit and the second substrate are in the first positional relationship and are supported by the support member, the head unit and the second substrate are connected together such that an electric signal supply path is formed from the second substrate to the head unit. Accordingly, image recording can be carried out by supplying an electric signal, which the print head needs to carry out image recording, from the second substrate to the head unit. Additionally, in such a case, since the head unit and the second substrate are supported in the adjacent state, the electric signal supply path can be made shorter and degradation of the electric signal can be suppressed. On the other hand, while supported in the second positional relationship, the head unit and the second substrate are disconnected from each other and the head unit is dismountable from the support member. Additionally, since the second substrate is provided separate to the head unit, there is no need to replace the second substrate and the head unit at the same time and, thus, the ease of maintenance is improved. Accordingly, the image recording device according to the aspect of the invention can improve both the ease of maintenance of the substrate used to control the print head and the suppression of signal degradation.

Furthermore, in the image recording device according to the aspect of the invention, while the head unit and the second substrate are in the second positional relationship and are supported by the support member, it is preferable that the second substrate is dismountable from the support member. Such a configuration allows the second substrate to be replaced separately from the head unit, and, thus, the ease of maintenance is further improved.

Furthermore, the support member may preferably include a first support member that supports the head unit in a detachable manner, a second support member that supports the second substrate in a detachable manner, and a relative displacement mechanism that allows relative displacement between the first support member and the second support member, and it is preferable that relative displacement of the first support member and the second support member through the relative displacement mechanism allows the positional relationship between the head unit and the second substrate to be changed between the first positional relationship and the second positional relationship. By providing such a relative displacement mechanism, the positional relationship between the head unit and the second substrate can be easily changed between the first positional relationship and the second positional relationship.

Note that, as an example of the relative displacement mechanism, the relative displacement mechanism may include a swing support member that supports the first support member and the second support member and that allows relative swinging between the first support member and the second support member. In such a case, by relatively swinging the first support member and the second support member, the positional relationship between the head unit and the second substrate can be easily changed between the first positional relationship and the second positional relationship.

In such a case, it is preferable that a mounting side, the mounting side being provided so as to extend in an extending direction that is orthogonal to the swinging direction in which the first support member and the second support member relatively swing, is provided in the second support member while being supported by the swing support member, and it is preferable that a slit is formed in the mounting side from one edge of the mounting side in an orthogonal direction that is orthogonal to the extending direction towards the other edge side and up to an intermediate portion of the mounting side such that the mounting side is divided into a plurality of mounting portions in the extending direction, the second substrate being mounted on each of the plurality of mounting portions. In such a configuration, since a slit is formed in the mounting side from one edge of the mounting side in an orthogonal direction that is orthogonal to the extending direction towards the other edge side and up to an intermediate portion of the mounting side, a plurality of mounting portion are formed in the mounting side in the extending direction. Moreover, since the second substrate is mounted on each mounting portion, operation of connecting the second substrate to the head unit and operation of releasing the connection can be carried out efficiently. In other words, since a slit is formed between the mounting portions, each mounting portion can be separately displaced in the swinging direction and, consequently, the second substrate mounted on each mounting portion can be displaced in the swinging direction. Accordingly, the plurality of second substrates can be connected or disconnected one by one from the head unit, and, thus, the connecting or disconnecting operation becomes easier.

Furthermore, it is preferable that an attaching mechanism that mounts the second substrate on the mounting portion while allowing relative displacement between the mounting portion and the second substrate is further provided. By providing such an attaching mechanism, the position of the second substrate can be adjusted with respect to the mounting portion. Accordingly, when the second substrate mounted on each mounting portion and the head unit are connected, the positioning of the two is facilitated and work efficiency in connecting the two is increased.

Furthermore, it is preferable that a connector mechanism including a first connector that is provided in the head unit and a second connector provided in the second substrate are further provided, in which relative displacement of the first support member and the second support member allows switching to be carried out between a state in which a connection between the first connector and the second connector is established such that the electric signal supply path from the second substrate to the head unit is formed and a state in which the connection between the first connector and the second connector is released. By providing such a connector mechanism, a state in which the electric signal supply path is formed between the head unit and the second substrate and a state in which electric signal supply path is not formed therebetween can be easily switched by relatively displacing the first support member and the second support member.

Furthermore, it is preferable that an engaging mechanism is further provided that suppresses relative displacement between the head unit and the second substrate that are supported by the support member and that are in the first positional relationship. By providing such an engaging mechanism, unintended release of the connection between the head unit and the second substrate, which are in the first positional relationship, caused by relative displacement of the two can be suppressed. Accordingly, the connection state of the head unit and the second substrate can be reliably maintained.

Furthermore, it is preferable that the print head and the first substrate are electrically coupled together with a cable that can be dismounted from at least either one of the print head and the first substrate. Accordingly, by electrically coupling the print head and the first substrate with a cable that can be dismounted from at least either one of the print head and the first substrate, the print head and the first substrate can be replaced separately, and, thus, the ease of maintenance is further improved.

Note that, as examples of the first substrate and the second substrate, the second substrate may include an electric circuit that generates a control signal in accordance with various conditions under which the image recording is carried out and the first substrate may include an electric circuit that generates, on the basis of the control signal generated in the second substrate, a driving signal for driving the print head. Alternatively, the second substrate may include an electric circuit that generates a control signal in accordance with various conditions under which the image recording is carried out and an electric circuit that generates, on the basis of the control signal, a driving signal for driving the print head, and the first substrate may include wiring that transmits the driving signal generated in the second substrate.

Furthermore, the print head may include a plurality of unit heads that are provided with a nozzle that ejects the liquid, in which the plurality of unit heads are preferably grouped into a plurality of groups that are each made up of two or more unit heads, and in which each group is preferably provided with a single first substrate and a single second substrate. If the print head includes the plurality of unit heads, and if only a single first substrate and a single second substrate are provided for all of the unit heads, the print head will lack versatility such as being able to provide the minimum required number of first substrate and second substrate according to the various types of recording medium with different widths, for example. On the other hand, if the first substrate and the second substrate are provided per unit head, processes required for the connection work connecting the first substrates and the second substrates together increase; accordingly, work efficiency in connecting the substrates is reduced. Accordingly, as described as above, by preferably providing a single first substrate and a single second substrate to each group made up of two or more unit heads, both the versatility and work efficiency can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
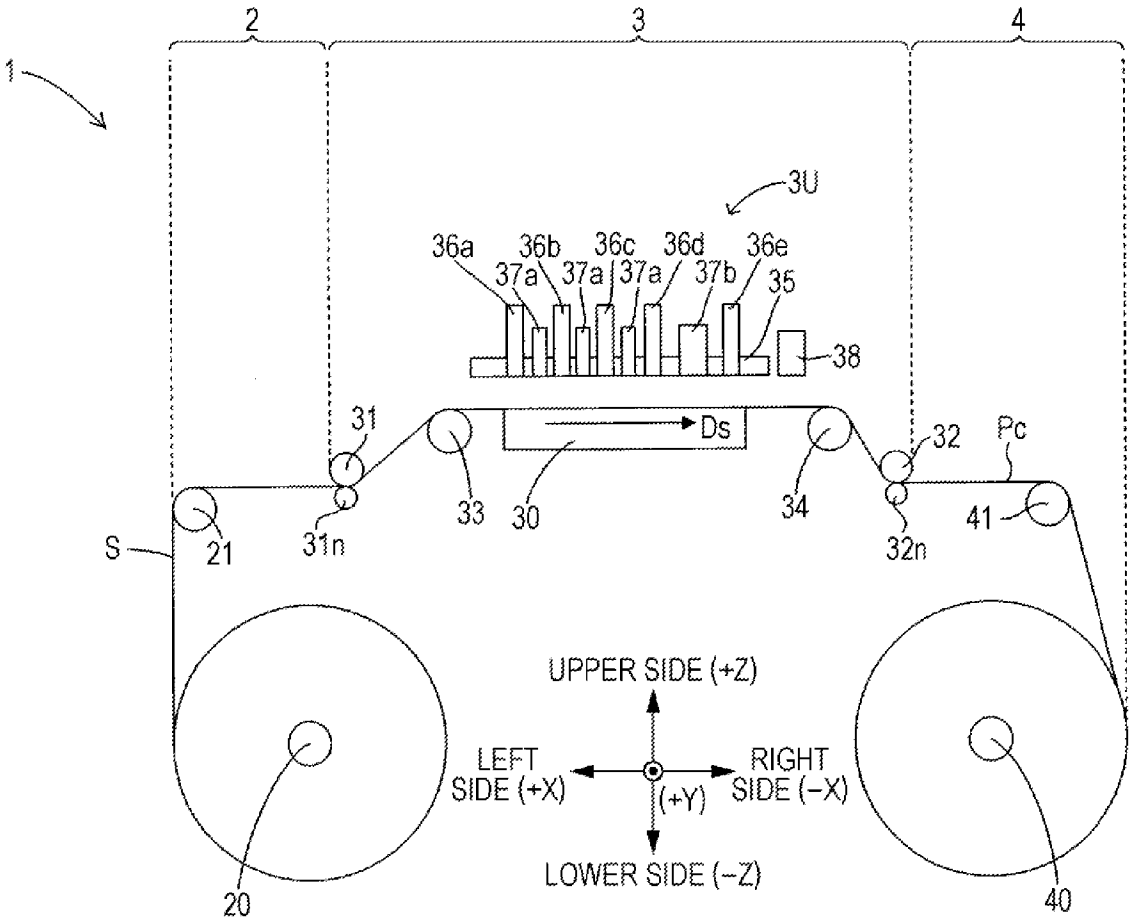
FIG. 1 is a front view schematically illustrating a configuration of an image recording device to which the aspect of the invention can be applied.

Exemplary embodiments of an image recording device according to the invention will be described below with reference to the drawings. FIG. 1 is a front view schematically illustrating an exemplary embodiment of the image recording device to which the invention can be applied. Note that in FIG. 1 and other drawings, a three-dimensional, orthogonal coordinate system corresponding to a left-right direction X, a front-rear direction Y, and a vertical direction Z of an image recording device 1 is adopted, as necessary, in order to clearly illustrate the positional relationships of the members of the device.

As illustrated in FIG. 1, in the image recording device 1, a feeding section 2, a processing section 3, and a winding section 4 are arranged in the left-right direction. The feeding section 2 and the winding section 4 include a feeding shaft 20 and a winding shaft 40, respectively. Furthermore, one of the two ends of a sheet S (web) is wound around the winding section 4 and the other end thereof is wound around the feeding section 2 such that the sheet S is stretched between the winding section 4 and the feeding section 2. The sheet S is transported from the feeding shaft 20 to the processing section 3 along a transport path Pc, in which the sheet S is stretched as described above, and is transported to the winding shaft 40 after an image recording process is carried out thereon with an image recording processor 3U. The types of sheet S are roughly classified into paper-based sheets and film-based sheets. Specific examples include, as for the paper-based sheets, woodfree paper, cast coated paper, art paper, coated paper, and the like, and, as for the film-based sheets, synthetic paper, polyethylene terephthalate (PET) film, polypropylene (PP) film, and the like. Note that in the following description, among the two sides of the sheet S, the side on which an image is recorded is referred to as a front side and, conversely, the side on the opposite side is referred to as a back side.

The feeding section 2 includes the feeding shaft 20 around which an end of the sheet S is wound and a driven roller 21 around which the sheet S that has been drawn out from the feeding shaft 20 is wound. The feeding shaft 20 winds the end of the sheet S and supports the sheet S while the front side of the sheet S faces toward the outside. Moreover, the feeding shaft 20 rotates in a clockwise direction with respect to the sheet surface of FIG. 1 so that the sheet S that is wound around the feeding shaft 20 is fed to the processing section 3 through the driven roller 21.

While the sheet S, which has been fed from the feeding section 2, is supported by a flat platen 30 having a flat supporting surface, the processing section 3 carries out image recording on the sheet S as appropriate by carrying out a process with the image recording processor 3U that is arranged along the surface of the platen 30. In the processing section 3, a front driving roller 31 and a rear driving roller 32 are provided at the two ends of the platen 30. An image is printed on the sheet S while the sheet S that is transported from the front driving roller 31 to the rear driving roller 32 is supported by the platen 30.

The front driving roller 31 has, on its outer peripheral surface, a plurality of microspikes that have been formed by thermal spraying. The front driving roller 31 winds the front side of the sheet S, which has been fed from the feeding section 2. Furthermore, the front driving roller 31 rotates in a counterclockwise direction with respect to the sheet surface of FIG. 1 such that the sheet S that has been fed from the feeding section 2 is transported downstream of the transport path Pc. Note that a nip roller 31*n* is provided for the front driving roller 31. The nip roller 31*n* is in contact with the back side of the sheet S while being biased towards the front driving roller 31 such that the sheet S is pinched between the nip roller 31*n* and the front driving roller 31. With the above arrangement, frictional force is generated between the front driving roller 31 and the sheet S; accordingly, the front driving roller 31 can transport the sheet S reliably.

The flat platen 30 is supported by a support mechanism (not shown) such that the supporting surface (upper surface) of the flat platen 30 that supports the sheet S is horizontal. Driven rollers 33 and 34 are respectively provided on the left side and right side of the platen 30. The driven rollers 33 and 34 wind the back side of sheet S that is transported from the front driving roller 31 to the rear driving roller 32. The upper end of the driven rollers 33 and 34 are positioned so as to be flush to or slightly lower than the surface of the platen 30 so that the sheet S that is transported from the front driving roller 31 to the rear driving roller 32 is kept in contact with the platen 30.

The rear driving roller 32 has, on its outer peripheral surface, a plurality of microspikes that have been formed by thermal spraying. The rear driving roller 32 winds the front side of the sheet S, which has been transported from the platen 30 through the driven roller 34. Furthermore, the rear driving roller 32 rotates in a counterclockwise direction with respect to the sheet surface of FIG. 1 so that the sheet S is transported to the winding section 4. Note that a nip roller 32*n* is provided for the rear driving roller 32. The nip roller 32*n* is in contact with the back side of the sheet S while being biased towards the rear driving roller 32 such that the sheet S is pinched between the nip roller 32*n* and the rear driving roller 32. With the above arrangement, frictional force is generated between the rear driving roller 32 and the sheet S; accordingly, the rear driving roller 32 can transport the sheet S reliably.

As described above, the sheet S that is transported from the front driving roller 31 to the rear driving roller 32 is transported on the platen 30 in a transport direction Ds while being supported by the platen 30. Furthermore, the image recording processor 3U that prints a color image on the front side of the sheet S that is supported by the platen 30 is provided in the processing section 3. Specifically, the image recording processor 3U includes four print heads 36*a* to 36*d* arranged from the upstream side to the downstream side in the transport direction Ds. The print heads 36*a* to 36*d* correspond to yellow, cyan, magenta, and black, respectively. Each of the print heads 36*a* to 36*d* opposes the front side of the sheet S, which is supported by the platen 30, with a slight clearance therebetween and ejects ink with the corresponding color using an ink jet method. Furthermore, each of the print heads 36*a* to

36*d* ejects ink on the sheet S that is transported in the transport direction Ds; accordingly, a color image is formed on the front side of the sheet S.

Incidentally, ultraviolet (UV) ink (photo-curing ink) that is cured by irradiation of ultraviolet rays (light) is used as the ink. Accordingly, the image recording processor 3U includes UV lamps 37*a* and 37*b* to cure the ink so that the ink is fixed to the sheet S. Note that the ink is cured in two separate stages, namely, a precuring stage and a full curing stage. UV lamps 37*a* for precuring are each arranged between the print heads 36*a* to 36*d*. In other words, the UV lamps 37*a* irradiate weak ultraviolet rays to cure (precure) the ink to the extent that the ink is prevented from deforming and do not totally cure the ink. On the other hand, a UV lamp 37*b* for full curing is provided downstream of the print heads 36*a* to 36*d* in the transport direction Ds. In other words, the UV lamp 37*b* irradiates ultraviolet rays that are stronger than that of the UV lamps 37*a* to completely cure (fully cure) the ink. By carrying out the precure and the full cure as described above, the color image formed by the print heads 36*a* to 36*d* can be fixed to the front side of the sheet S.

The image recording processor 3U further includes a print head 36*e* downstream of the UV lamp 37*b* in the transport direction Ds. The print head 36*e* opposes the front side of the sheet S, which is supported by the platen 30, with a slight clearance therebetween and ejects a transparent UV ink on the front side of the sheet S using an ink jet method. In other words, a transparent ink is further ejected over the color image formed by the print heads 36*a* to 36*d* with four colors. Furthermore, a UV lamp 38 is provided separate to the image recording processor 3U and downstream of the print head 36*e* in the transport direction Ds. The UV lamp 38 irradiates strong ultraviolet rays to completely cure (fully cure) the transparent ink ejected by the print head 36*e*. Accordingly, the transparent ink is fixed to the front side of the sheet S.

As described above, in the processing section 3, ejection and curing of ink are carried out as appropriate such that a color image coated with the transparent ink is formed on the sheet S that is supported by the platen 30. Furthermore, the sheet S, on which the color image is formed, is transported to the winding section 4 by the rear driving roller 32.

The winding section 4 includes the winding shaft 40 around which the end of the sheet S is wound and a driven roller 41 around which the sheet S transported to the winding shaft 40 is wound. The winding shaft 40 winds the end of the sheet S and supports the sheet S while the front side of the sheet S faces toward the outside. Moreover, the winding shaft 40 rotates in a clockwise direction with respect to the sheet surface of FIG. 1 so that the sheet S is wound around the winding shaft 40 through the driven roller 41.

Now, the image recording processor 3U includes a carriage 35 that integrally supports the print heads 36*a* to 36*e* and UV lamps 37*a* and 37*b* that are arranged in the transport direction Ds. In particular, each of the print heads 36*a* to 36*e* are supported by the carriage 35 through support members described below and constitutes a head mechanism together with the support members. Details of the head mechanism will be described below. Note that, since the print heads 36*a* to 36*e* have a similar configuration, a description is given referring to each of the print heads 36*a* to 36*e* as a print head 36 without distinguishing the print heads 36*a* to 36*e* from each other.

Figure 2:
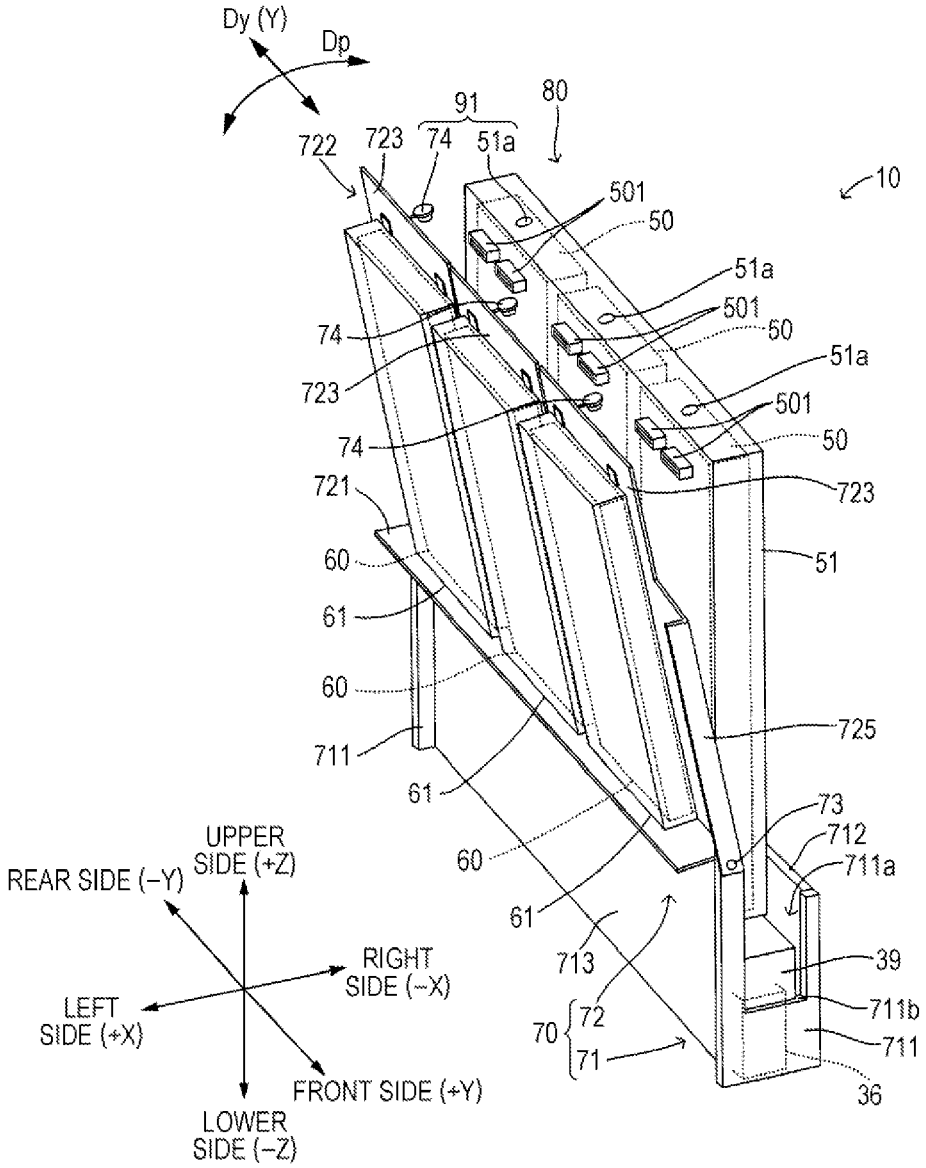
FIG. 2 is a perspective view schematically illustrating an exemplary configuration of a head mechanism.
Figure 3B:
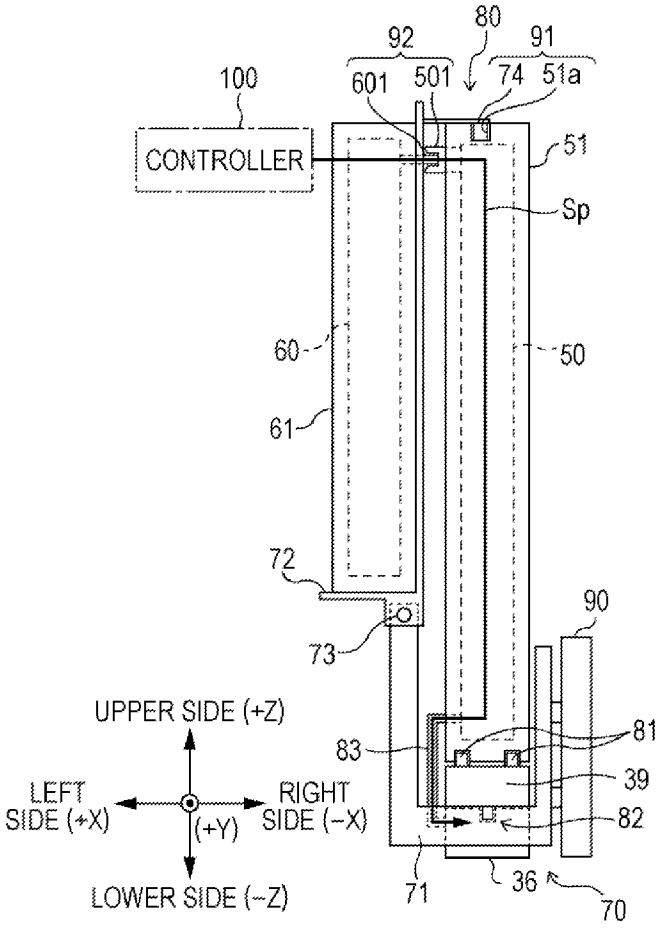
FIGS. 3A and 3B are front views schematically illustrating positional relationships between substrates of the head mechanism of FIG. 2.
Figure 3A:
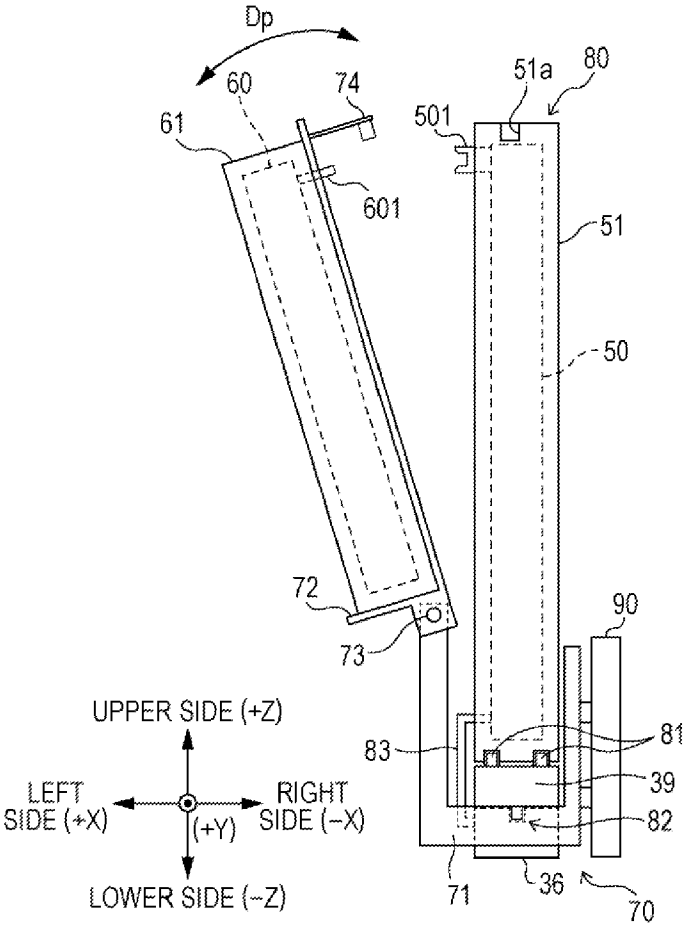
Figure 4:
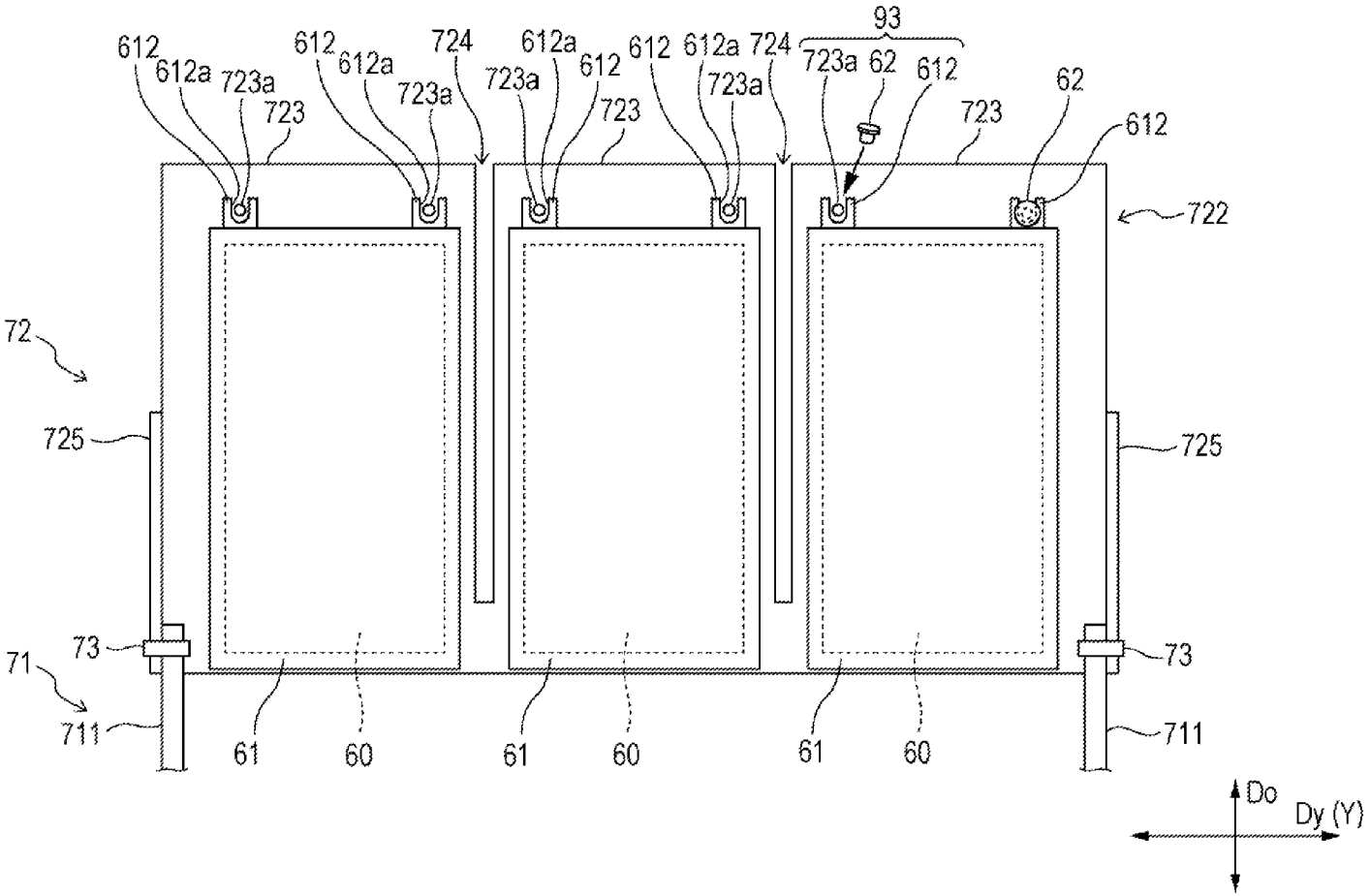
FIG. 4 is a side view schematically illustrating the manner in which the control substrates of the head mechanism of FIG. 2 are attached.

FIG. 2 is a perspective view schematically illustrating an exemplary configuration of the head mechanism, FIG. 3 is a front view schematically illustrating a positional relationship between each substrate of the head mechanism of FIG. 2, and FIG. 4 is a side view schematically illustrating a manner in which the control substrates of the head mechanism of FIG. 2 are attached. As illustrated in FIGS. 2 and 3, a head mechanism 10 includes a head unit 80 having a print head 36 and drive substrates 50, the control substrates 60, and a support member 70 that supports the control substrates 60 and the head unit 80. Each pair of drive substrates 50 and control substrates 60 include a circuit substrate that generates an electric signal used to control the print head 36. This will be described in detail later.

The print head 36 extends in an extending direction Dy that extends in a front-rear direction (Y direction), and, in accordance with the print head 36, the entire head mechanism 10 is shaped so as to extend in the extending direction Dy as well. Three drive substrates 50 are arranged separate from each other in the extending direction Dy. The drive substrates 50 are each arranged above the corresponding print head 36 while they are accommodated in a housing case 51. More specifically, an intermediate member 39 is provided over the print heads 36, and, further, the drive substrates 50 are provided over the intermediate member 39. As illustrated in FIG. 3, an attaching and detaching mechanism 81 that enables the intermediate member 39 and the housing case 51 to be attached and detached from each other is provided between an upper surface of the intermediate member 39 and the housing case 51 accommodating the drive substrate 50, and, further, an attaching and detaching mechanism 82 that enables the intermediate member 39 and the print head 36 to be attached and detached from each other is provided between an underside of the intermediate member 39 and the print head 36. Furthermore, each print head 36 and the corresponding drive substrate 50 are electrically coupled to each other with a flexible flat cable (FFC) 83. FFC 83 can be detached from at least either one of the print head 36 and the drive substrate 50. As described above, the print head 36 and the head unit 80 including the drive substrates 50 are configured such that the print head 36 and the drive substrates 50 are mechanically coupled to each other through the intermediate member 39 and are electrically coupled to each other through FFC 83.

Referring back to FIG. 2, three control substrates 60 are arranged separate from each other in the extending direction Dy in a similar manner to the drive substrates 50. The width of the control substrates 60 in the extending direction Dy is substantially the same as the width of the drive substrates 50 in the extending direction Dy. The control substrates 60 are each separately accommodated in a corresponding housing case 61 and are each arranged at a position that is substantially the same as that of a corresponding drive substrate 50 in the extending direction Dy.

The support member 70 includes a first support member 71 that supports the head unit 80 and a second support member 72 that supports the control substrates 60, the second support member 72 being capable of swinging in a swinging direction Dp about a swinging shaft 73 with respect to the first support member 71. The swinging shaft 73 extends in the extending direction Dy, and the swinging direction Dp of the second support member 72 is orthogonal to the extending direction Dy and is oriented along an arc centered on the swinging shaft 73.

The first support member 71 includes a pair of side walls 711 provided at opposite sides of the head mechanism 10 in the extending direction Dy, a side wall 712 provided on the right side (−X side) and a side wall 713 provided on the left side (+X side). Furthermore, the side walls 711, 711, 712, and 713 form an internal space that penetrates the first support member 71 in the up-down direction (Z direction). A lower end portion of the head unit 80 including the print head 36 is inserted into the internal space. A notch 711*a* open upward is formed in the pair of side walls 711 that are provided at the opposite sides of the head mechanism 10 in the extending direction Dy. Note that the length of the print head 36 in the extending direction Dy is shorter than the distance between the inner wall surfaces of the pair of side walls 711, and the length of the intermediate member 39 in the extending direction Dy is longer than the distance between the inner wall surfaces of the pair of side walls 711. Accordingly, when the head unit 80 is inserted into the internal space from above, the print head 36 fits between the pair of side walls 711, and the two ends of the intermediate member 39 in the extending direction Dy comes into contact with bottom surfaces 711*b* of the notches 711*a* such that the intermediate member 39 is supported by the bottom surfaces 711*b*. The head unit 80 is thus supported by the first support member 71. Note that, when the head unit 80 is supported by the first support member 71, the lower end portion of the print head 36 protrudes downwards from the first support member 71 (see FIG. 3).

Meanwhile, the second support member 72 has, as its basic shape, an L-shaped section on an xz plane and includes a base 721 extending in the direction Dy and a mounting side 722 that is substantially orthogonal to the base 721 while extending upwards. The second support member 72 further includes lateral sides 725 that are provided at opposite sides of the second support member 72 in the extending direction Dy and that protrude from the mounting side 722 in the swinging direction Dp. Moreover, the lateral sides 725 are connected to the side wall 711 of the first support member 71 with the swinging shaft 73; accordingly, the second support member 72 can be swung with respect to the first support member 71. Note that the second support member 72 is fabricated from a material with a certain elasticity.

Note that, as illustrated in FIG. 4, two slits 724 are provided in the mounting side 722 in an orthogonal direction Do, which is orthogonal to the extending direction Dy. The slits are formed from one edge of the mounting side 722 in the orthogonal direction Do (the upper end side in FIG. 4) towards the other edge (the lower end side in FIG. 4) and up to an intermediate portion of the mounting side 722. With such slits 724, the mounting side 722 is separated into three mounting portions 723 that are arranged apart from each other in the extending direction Dy. Furthermore, by mounting each control substrate 60 accommodated in a corresponding housing case 61 on a corresponding mounting portion 723, each control substrate 60 can be swung in the swinging direction Dp in the following manner. Specifically, since a slit 724 is provided between the mounting portions 723, each of the mounting portions 723 can individually deform itself in the swinging direction Dp according to its elasticity. Accordingly, each of the control substrates 60 mounted on a corresponding mounting portion 723 can be individually displaced in the swinging direction Dp. Meanwhile, since the slits 724 are only formed intermediately in the orthogonal direction Do, each of the mounting portions 723 is connected in the extending direction Dy in the area where the slits 724 are not formed. Accordingly, all of the mounting portions 723 can be integrally swung in the swinging direction Dp.

A manner in which the housing cases 61, which accommodate the control substrates 60, are attached to the mounting portion 723 will be described with reference to FIG. 4. Attaching portions 612 each with a U-shaped notch 612*a* are provided at the upper end portion of the housing case 61. On the other hand, screw holes 723*a* are formed in the mounting portion 723 at positions corresponding to the positions of the attaching portions 612. When the housing cases 61 are attached to the mounting portion 723, the notches 612*a* of the attaching portions 612 and the screw holes 723*a* of the mounting portions 723 are positioned so that they overlap each other in a plane extending along the mounting portions 723. After the positioning is completed, screws 62 are screwed into the screw holes 723*a*; accordingly, the housing cases 61 are attached to the mounting portion 723. In other words, an attaching mechanism 93 is constituted by screws 62, attaching portions 612, and screw holes 723*a*.

Note that the head of the screw 62 has a diameter that is larger than an inside dimension of the notch 612*a*, and the shaft of the screw 62 has a diameter that is smaller than the inside dimension of the notch 612*a*. Accordingly, when the housing case 61 is attached to the mounting portion 723, a gap is created between the shaft of the screw 62 and the attaching portion 612 allowing some play to exist. Accordingly, the control substrate 60 is mounted on the mounting portion 723 in a state allowing relative displacement between itself and the mounting portion 723.

With the head mechanism 10 having the above-described configuration, the positional relationship between the head unit 80 and the control substrate 60 can be changed between a separated state (FIG. 3A) in which the head unit 80 and the control substrate 60 are away from each other and an adjacent state (FIG. 3B) in which the head unit 80 and the control substrate 60 are close to each other, by swinging the second support member 72 in the swinging direction Dp with respect to the first support member 71.

Referring next to FIGS. 2 and 3, a configuration for connecting the head unit 80 and the control substrates 60 when the head unit 80 and the control substrates 60 are in the adjacent state will be described. A first connector 501 is provided in each drive substrate 50, and each first connector 501 protrudes in the swinging direction Dp towards a corresponding control substrate 60 side through openings formed in the housing case 51. On the other hand, a second connector 601 is provided in each control substrate 60 at a position allowing connection with a corresponding first connector 501 when the head unit 80 and the control substrates 60 are in the adjacent state. Each second connector 601 protrudes in the swinging direction Dp towards the drive substrate 50 side through openings formed in a corresponding housing case 61 and the mounting portion 723. Moreover, a connector mechanism 92 (see FIG. 3B) is constituted by the first connector 501 and the second connector 601. The connector mechanism 92 is a so-called direct connector mechanism in which electrical connection between the drive substrate 50 and the control substrate 60 can be achieved by merely engaging each other.

Here, in order to perform image recording in an appropriate manner, the connection state of the first connector 501 and the second connector 601 needs to be reliably maintained. Accordingly, engaging mechanisms 91 are provided in the head mechanism 10 that suppress relative displacement in the swinging direction Dp between the head unit 80 (drive substrates 50) and the control substrates 60, which are in the adjacent state. Specifically, each engaging mechanism 91 includes an engagement member 74 that is provided at the upper end portion of each mounting portion 723 that mounts a corresponding control substrate 60 thereon and an engagement hole 51*a* that is formed on the upper surface of the housing case 51 that accommodates the drive substrates 50 therein. Each engagement member 74 and the corresponding engagement hole 51*a* are provided at substantially the same position in the extending direction Dy. Moreover, by engaging the engagement member 74 with the engagement hole 51*a* when the head unit 80 and the control substrates 60 are in the adjacent state, relative displacement of the mounting portions 723 (control substrates 60) in the swinging direction Dp with respect to the head unit 80 can be suppressed (see FIG. 3B).

Referring still to FIGS. 3A and 3B, description of the operation for switching between a state allowing the head unit 80 or the control substrates 60 to be dismounted from the support member 70 and a state allowing image recording to be carried out by connecting the head unit 80 and the control substrates 60 together will be given. FIG. 3A illustrates the separated state in which the head unit 80 and the control substrates 60 are moved away from each other, and FIG. 3B illustrates the adjacent state in which the head unit 80 and the control substrates 60 are moved close to each other.

The separated state of the head unit 80 and the control substrates 60 is achieved by swinging the second support member 72 in the direction away from the first support member 71 (FIG. 3A). As described above, by moving the head unit 80 and the control substrates 60 away from each other, the first connector 501 of each drive substrate 50 and the second connector 601 of the corresponding control substrate 60 are disconnected. At this time, as described as above, by forming the slits 724 on the mounting side 722 on which the control substrates 60 are mounted, the control substrate 60 mounted on each mounting portion 723 can be separately displaced in the swinging direction Dp. Accordingly, the control substrate 60 mounted on each mounting portion 723 can be moved away from the head unit 80 separately and, thus, operation of disconnecting the first connector 501 and the second connector 601 can be facilitated. Moreover, once all of the control substrates 60 are disconnected from the head unit 80, the head unit 80 can be dismounted from the first support member 71 and, further, the control substrates 60 can be dismounted from the second support member 72. Note that as long as all of the connections between the control substrates 60 and the head unit 80 are released, the head unit 80 can be dismounted from the first support member 71 and the control substrate 60 can be dismounted from the second support member 72 without having to displace the control substrates 60 and the head unit 80 to the separated state illustrated in FIG. 3A.

Various configurations for dismounting the head unit 80 from the first support member 71 can be adopted. For example, an appropriate guide mechanism may be provided between the first support members 71 and the head unit 80 such that the head unit 80 can be dismounted from the first support member 71 along the guide mechanism. Alternatively, the head mechanism 10 may be configured to allow the head unit 80 to be dismounted from the first support member 71 just by pulling out the head unit 80. Note that after the head unit 80 is dismounted from the first support member 71, each drive substrate 50 and the corresponding print head 36 can be separated from each other by releasing the attaching and detaching mechanisms 81 and 82 that are attached to the drive substrate 50 and the print head 36, respectively, and by dismounting the corresponding FFC 83 from at least either one of the print head 36 and the drive substrate 50.

On the other hand, each control substrate 60 can be dismounted from the second support member 72 by dismounting a corresponding housing case 61, which accommodates the control substrate 60, from a corresponding mounting portion 723 by loosening the screws 62 (see FIG. 4) from the screw holes 723*a* or totally removing the screws 62.

Subsequently, a case in which the head unit 80 and the control substrates 60 are connected to each other will be described. In connecting the head unit 80 and the control substrates 60 to each other, first, the second support member 72 is swung in the direction that approaches the first support member 71 such that the head unit 80 and the control substrates 60 are in the adjacent state (FIG. 3B). By having the head unit 80 and the control substrates 60 become close to each other in the above manner, the first connectors 501 of the drive substrates 50 and the second connectors 601 of the control substrates 60 can be connected to each other. Each of the above connection forms an electric signal supply path Sp ranging from the control substrate 60 to the print head 36 via the connector mechanism 92, the drive substrate 50, and FFC 83.

Figure 5:
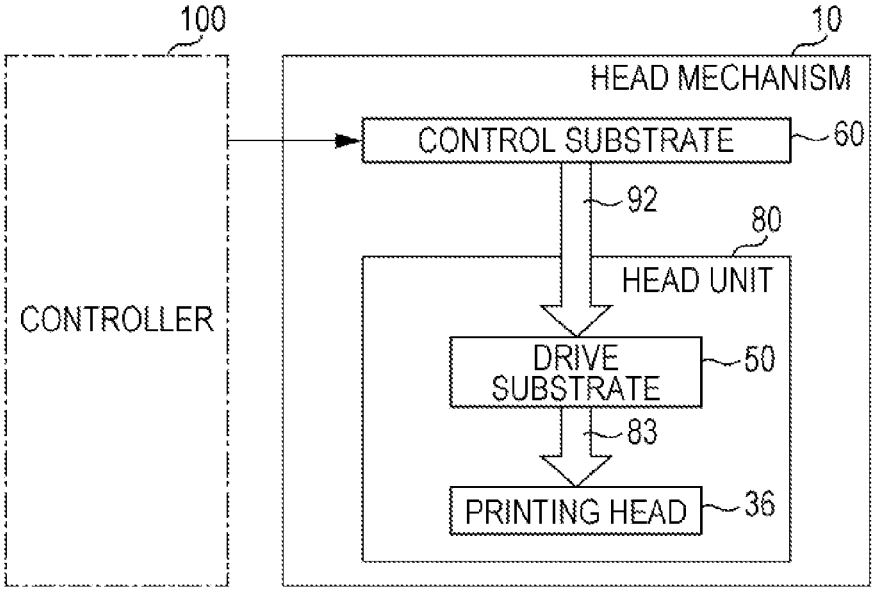
FIG. 5 is a block diagram schematically illustrating an electrical configuration of the head mechanism of FIG. 2.

A flow of the electric signal when image recording is carried out will now be described. FIG. 5 is a block diagram schematically illustrating an electrical configuration of the head mechanism of FIG. 2. The image recording device 1 is provided with a controller 100 that converts input image data into print data that is suitable for printing with the image recording device 1 by performing predetermined processes, such as half-toning and rasterizing, on the input image data (see JP-A-2003-76509, for example). Furthermore, this print data is transmitted from the controller 100 to the control substrate 60 using, for example, digital signals.

The control substrate 60 is provided with an electric circuit that generates a control signal for controlling the operation of the print head 36 in accordance with various conditions under which the image recording is carried out. For example, the timing in which ink is ejected from the print head 36 needs to be appropriately controlled in accordance with, for example, the transport speed of the sheet S. Furthermore, ejection characteristics of the ink ejected from a nozzle of the print head 36 change in accordance with, for example, the temperature of the ink; accordingly, the operation of the print head 36 may be appropriately controlled on the basis of, for example, temperatures. Accordingly, in the control substrate 60, a control signal for controlling the operation of the print head 36 is generated in accordance with the transport speed of the sheet S, the temperature of the ink, and the like.

The control signal generated in the control substrate 60 is transmitted to the drive substrate 50 using, for example, a digital signal via the connector mechanism 92 that is constituted by the first connector 501 and the second connector 601. The drive substrate 50 includes an electric circuit that generates a control signal on the basis of a driving signal that is needed to drive the print head 36. Furthermore, the driving signal is transmitted from the drive substrate 50 to the print head 36 via FFC 83, and the print head 36 ejects ink in accordance with the driving signal to carry out image recording.

As described above, the electric signals (the control signal and the driving signal) for controlling each print head 36 provided in the image recording device 1 are generated in the drive substrate 50 and the control substrate 60 that are integrally provided with each print head 36 in the head mechanism 10. Accordingly, the above-described supply path Sp can be made short and the degradation of the electric signals transmitted from the control substrate 60 to the print head 36 via the drive substrate 50 can be suppressed. In particular, the driving signal for driving the print head 36 is generally an analog signal that is prone to degradation; however, since the drive substrate 50 and the print head 36 are integrally provided with the head unit 80, FFC 83 connecting the drive substrate 50 and the print head 36 to each other can be made short and, thus, degradation of signal can be suppressed.

Figure 6:
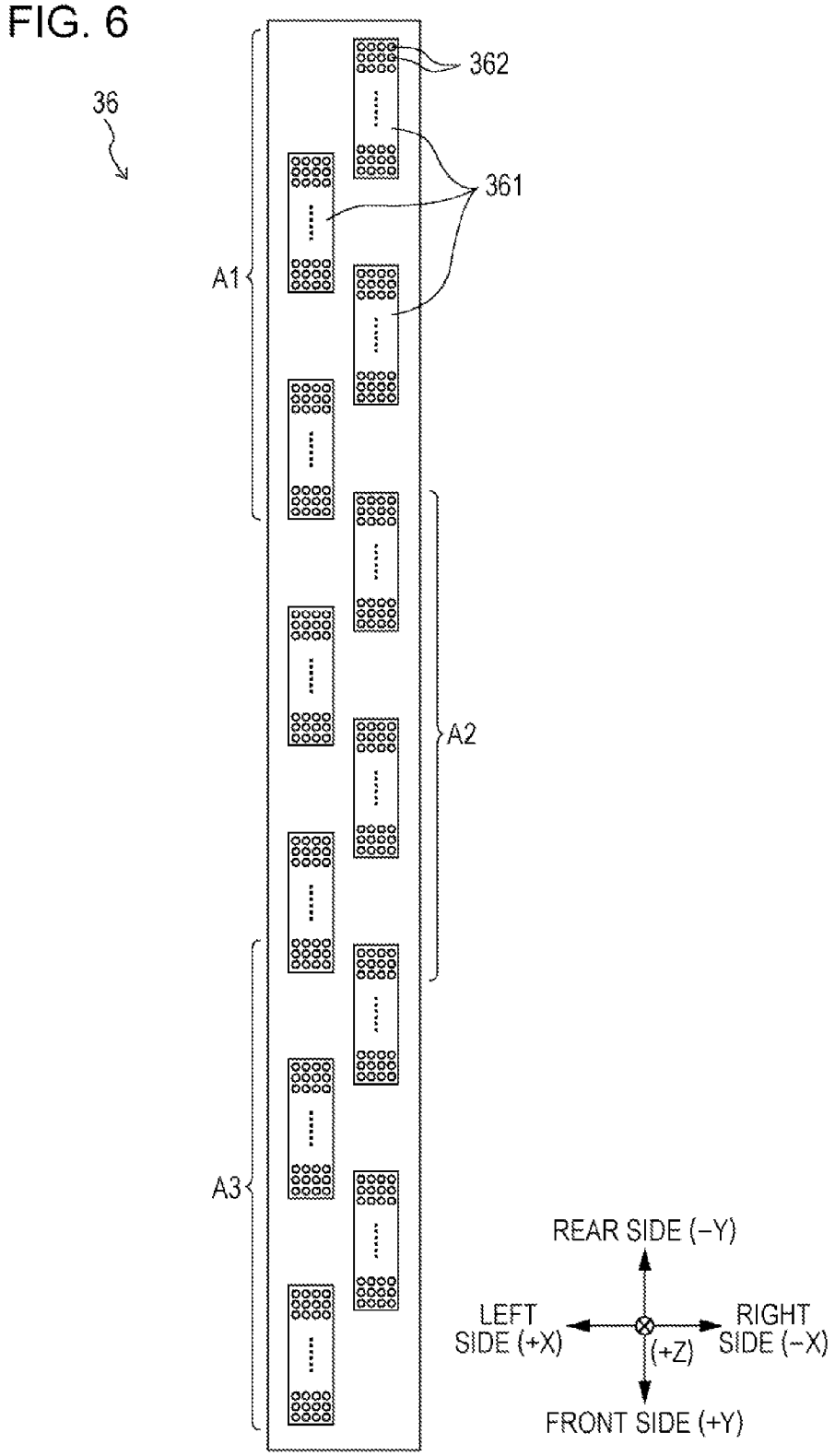
FIG. 6 is a bottom view schematically illustrating a configuration of a print head.

Subsequently, a description will be given of the reason why three drive substrates 50 and three control substrates 60 are provided. FIG. 6 is a bottom view schematically illustrating a configuration of a print head. The print head 36 includes a plurality of unit heads 361 each having a plurality of nozzles 362 arranged in a two dimensional manner. In the present exemplary embodiment, six unit heads 361 are arranged in a row in the front-rear direction, and two of these rows are arranged in the left-right direction while being offset to each other in the front-rear direction; accordingly, a total number of twelve unit heads 361 are arranged in a staggered manner.

In the print head 36 configured as above, if only a single drive substrate 50 and a single control substrate 60 are provided for all the twelve unit heads 361, the print head 36 will lack versatility such as being able to provide the minimum required number of drive substrates 50 and control substrates 60 according to the various types of sheets S with different widths. Conversely, if a drive substrate 50 and a control substrate 60 are provided per unit head 361, processes required for the connection work connecting the drive substrates 50 and the control substrates 60 together increase; accordingly, work efficiency in connecting the substrates is reduced. Accordingly, in the present exemplary embodiment, a single drive substrate 50 and a single control substrate 60 are provided to each group of four unit heads 361, namely, group A1, group A2, and group A3, such that the above-described versatility and work efficiency are both achieved. Note that the number of unit heads 361 constituting each group is not limited to four and may be any number more than one.

Incidentally, when image recording is carried out, in order to set the clearance between the print head 36 and the sheet S at an appropriate distance in accordance with the thickness of the sheet S, there are cases in which the print head 36 is displaced in the up-down direction (a direction moving towards and away from the sheet S) to adjust the position of the print head 36. Furthermore, there are cases in which a maintenance unit is provided to carry out maintenance on the print head 36. In such cases, there are cases in which the print head 36 is displaced in the up-down direction to disjunct the print head 36 from the maintenance unit. For the above case, an elevating mechanism 90 that moves the support member 70, which supports the head unit 80 and the control substrates 60, is provided in the head mechanism 10 (see FIG. 3).

The above-described elevating mechanism 90 moves the support member 70 in the up-down direction; accordingly, the position of the print head 36 (head unit 80) in the up-down direction can be adjusted. At this time, in the present head mechanism 10, the head unit 80 can be displaced up and down even when the head unit 80 and the control substrates 60 are kept connected since the head unit 80 and the control substrates 60 are supported by a common support member 70.

As described above, the head mechanism 10 of the present exemplary embodiment includes a head unit 80 integrally including a print head 36 that performs image recording by ejecting ink onto a sheet S and a drive substrate 50 that supplies an electric signal (a driving signal) that is used to control the print head 36 to the print head 36; a control substrate 60 that is provided separate to the head unit 80, the control substrate 60 supplying an electric signal (a control signal) used to control the print head 36 to the head unit 80; and a support member 70 that supports the head unit 80 and the control substrates 60 while allowing a positional relationship between the head unit 80 and the control substrates 60 to be changed between an adjacent state in which the head unit 80 and the control substrate 60 are close to each other and a separated state in which the head unit 80 and the control substrate 60 are away from each other. In the present exemplary embodiment, while the head unit 80 and the control substrates 60 are in the adjacent state and are supported by the support member 70, the head unit 80 and the control substrates 60 are connected together such that an electric signal supply path Sp is formed from the control substrate 60 to the head unit 80, and, meanwhile, while the head unit 80 and the control substrates 60 are in the separated state and are supported by the support member 70, the head unit 80 and the control substrates 60 are disconnected from each other and the head unit 80 can be dismounted from the support member 70.

As described above, when in the adjacent state, mutual connection between the head unit 80 and each control substrate 60 is established that forms the supply path Sp for supplying electric signals from the control substrate 60 to the head unit 80; accordingly, image recording can be carried out by feeding the required electric signal from the control substrate 60 to the head unit 80. Moreover, in the above case, because the head unit 80 and the control substrates 60 are supported while they are close to each other, the supply path Sp of the electric signals can be shortened and degradation of electric signals can be suppressed. On the other hand, when in the separated state, the mutual connection between the head unit 80 and each control substrate 60 is released and the head unit 80 can be dismounted from the support member 70. Moreover, because the control substrates 60 are provided as separate bodies with respect to the head unit 80, there is no need to replace the control substrates 60 and the head unit 80 at the same time anymore; accordingly, the ease of maintenance is improved. As described above, improvement in the ease of maintenance of the substrates 50 and 60 used to control the print head 36 and the suppression of degradation of the signals can both be achieved.

Furthermore, in the present exemplary embodiment, when in the separated state, since the mutual connection between the head unit 80 and each control substrate 60 is released, each control substrate 60 can be dismounted from the support member 70. Accordingly, the control substrate 60 and the head unit 80 can be replaced separately and, thus, the ease of maintenance is further improved.

Furthermore, in the present exemplary embodiment, the support member 70 includes a first support member 71 that supports the head unit 80 in a detachable manner, a second support member 72 that supports the control substrate 60 in a detachable manner, and a relative displacement mechanism (swinging shaft 73) that allows relative displacement between the first support member 71 and the second support member 72, and relative displacement of the first support member 71 and the second support member 72 through the relative displacement mechanism allows the positional relationship between the head unit 80 and the control substrates 60 to be changed between the adjacent state and the separated state. By providing such a relative displacement mechanism, the positional relationship between the head unit 80 and the control substrates 60 can be easily changed between the adjacent state and the separated state.

Note that, in the present exemplary embodiment, the relative displacement mechanism includes a swinging shaft 73 that supports the first support member 71 and the second support member 72 and that allows relative swinging between the first support member 71 and the second support member 72. Accordingly, by relatively swinging the first support member 71 and the second support member 72, the positional relationship between the head unit 80 and the control substrates 60 can be easily changed between the adjacent state and the separated state.

Furthermore, in the present exemplary embodiment, a mounting side 722, the mounting side 722 provided so as to extend in an extending direction Dy that is orthogonal to the swinging direction Dp in which the first support member 71 and the second support member 72 relatively swing, is provided in the second support member 72 while being supported by the swinging shaft 73, and a slit 724 is formed in the mounting side 722 from one edge of the mounting side 722 in an orthogonal direction Do that is orthogonal to the extending direction Dy towards the other edge side and up to an intermediate portion of the mounting side 722 such that the mounting side 722 is divided into a plurality of mounting portions 723 in the extending direction Dy, the control substrate 60 being mounted on each of the plurality of mounting portions 723. With such a configuration, each mounting portion 723 is mounted on the corresponding control substrate 60; accordingly, the operation of connecting each control substrate 60 to the head unit 80 and the operation of releasing the connection can be carried out efficiently. In other words, since a slit is formed between the mounting portions 723, each mounting portion 723 can be separately displaced in the swinging direction Dp and, consequently, the control substrate 60 mounted on each mounting portion 723 can be displaced separately in the swinging direction Dp. Thus, the plurality of control substrates 60 can each be connected to the head unit 80 separately and each of the connection can each be released separately; accordingly, the connecting operation and the releasing operation can be facilitated.

Furthermore, in the present exemplary embodiment, an attaching mechanism 93 that mounts the control substrate 60 on the mounting portion 723 while allowing relative displacement between the mounting portion 723 and the control substrate 60 is provided. By providing the attaching mechanism 93, the position of the control substrate 60 can be adjusted with respect to the mounting portion 723. Accordingly, when the control substrate 60 mounted on each mounting portion 723 and the head unit 80 are connected, the positioning of the two is facilitated and work efficiency in connecting the two is increased.

Furthermore, the present exemplary embodiment further includes an engaging mechanism 91 that suppresses relative displacement between the head unit 80 and the control substrate 60 that are in the adjacent state. By providing such an engaging mechanism 91, unintended release of the connection between the head unit 80 and the control substrate 60, which are in the adjacent state, caused by relative displacement of the two can be suppressed. Accordingly, the connection state of the head unit 80 and the control substrate 60 can be reliably maintained.

Furthermore, the present exemplary embodiment further includes a connector mechanism 92 including a first connector 501 that is provided in the head unit 80 and a second connector 601 provided in the control substrate 60, in which relative displacement of the first support member 71 and the second support member 72 allows switching to be carried out between a state in which a connection between the first connector 501 and the second connector 601 is established such that the electric signal supply path Sp from the control substrate 60 to the head unit 80 is formed and a state in which the connection between the first connector 501 and the second connector 601 is released. By providing such a connector mechanism 92, a state in which the electric signal supply path Sp is formed between the head unit 80 and the control substrate 60 and a state in which the electric signal supply path Sp is not formed therebetween can be easily switched by relatively displacing the first support member 71 and the second support member 72.

Furthermore, the present exemplary embodiment further includes attaching and detaching mechanisms 81 and 82 that allows the print head 36 and the drive substrate 50 to become attached or detached, and the print head 36 and the drive substrate 50 are electrically coupled together with FFC 83 that can be dismounted from at least either one of the print head 36 and the drive substrate 50. As described above, by providing the attaching and detaching mechanisms 81 and 82 that allow the print head 36 and the drive substrate 50 to become attached or detached, the print head 36 and the drive substrate 50 can be mechanically separated from each other. Furthermore, since the print head 36 and the drive substrate 50 are electrically coupled together with FFC 83 that can be dismounted from at least either one of the print head 36 and the drive substrate 50, the print head 36 and the drive substrate 50 can be electrically separated from each other. Accordingly, the print head 36 and the drive substrate 50 can be replaced separately and the ease of maintenance can be further improved.

As described above, in the exemplary embodiment, the sheet S corresponds to a "recording medium" of the invention, the UV ink corresponds to a "liquid" of the invention, the drive substrate corresponds to a "first substrate" of the invention, the control substrate 60 corresponds to a "second substrate" of the invention, the swinging shaft 73 corresponds to a "swing support member" of the invention, and FFC 83 corresponds to a "cable" of the invention. Furthermore, the adjacent state corresponds to a "first positional relationship" of the exemplary embodiment and the separated state corresponds to a "second positional relationship" of the exemplary embodiment of the invention.

Note that the invention is not limited to the exemplary embodiment described above and the elements of the exemplary embodiment described above may be appropriately combined or various modifications may be made as long as they do not depart from the spirit of the invention. For example, in the exemplary embodiment described above, the drive substrate 50 and the control substrate 60 are connected by the direct connector mechanism 92, and the drive substrate 50 and the print heads 36 are connected by FFC 83; however, the connection form between the components may be appropriately modified. For example, the drive substrate 50 and the control substrate 60 may be connected by a cable such as FFC. In such a case, the connection between the head unit 80 and the control substrates 60 may be released by dismounting the cable after changing the head unit 80 and the control substrate 60 to the separated state.

Furthermore, in the exemplary embodiment described above, a mechanism that swings the second support member 72 with respect to the first support member 71 about the swinging shaft 73 is adopted as the relative displacement mechanism that relatively displaces the first support member 71 and the second support member 72. However, the configuration of the relative displacement mechanism is not limited to this and, for example, the relative displacement mechanism may be configured such that a slide mechanism, a link mechanism, or the like is provided between the first support member 71 and the second support member 72. Furthermore, the configuration may be such that the first support member 71 is displaced with respect to the second support member 72 in relatively displacing the first support member 71 and the second support member 72.

Furthermore, in the exemplary embodiment described above, slits are formed part-way of a single mounting side 722 such that the plurality of mounting portions 723 are formed in the mounting side 722 in the extending direction Dy; however, the configuration in providing a plurality of mounting portions 723 is not limited to this configuration. For example, a plurality of plate-shaped members each functioning as a mounting portion 723 that are separately arranged in the extending direction Dy may be provided in the second support member 72.

Furthermore, the function of the electric circuit provided in each substrate may be changed as appropriate. For example, the "second substrate" of the exemplary embodiment of the invention may be a substrate that includes both an electric circuit that generates the control signal described above and an electric circuit that generates a driving signal on the basis of the control signal, and the "first substrate" of the exemplary embodiment of the invention may be a substrate that includes a function of merely transmitting the above driving signal from the second substrate to the print head 36 (a so-called relay substrate). Such a relay substrate is only required to have wiring for transmitting the driving signal described above; accordingly, the first substrate can be small and inexpensive, and consequently, the head unit 80 can be small and inexpensive.

Furthermore, in the exemplary embodiment described above, the print head 36 is configured with a plurality of unit head 361; however, this configuration is not essential to the invention. Furthermore, in the exemplary embodiment described above, a single drive substrate 50 and a single control substrate 60 are provided to each of the four unit heads 361; however, the number of drive substrates 50 and control substrates 60 can be changed as appropriate.

Furthermore, in the exemplary embodiment described above, the platen 30 has a flat supporting surface; however, the sheet S may be supported by, for example, a platen drum that has an arcuate supporting surface.

Furthermore, ink that is ejected from the print head 36 is not limited to UV ink and may be changed as appropriate.

The entire disclosure of Japanese Patent Application No. 2013-065783, filed Mar. 27, 2013 is expressly incorporated by reference herein.

What is claimed is:

1. An image recording device, comprising:

a head unit including a print head that performs image recording by ejecting a liquid onto a recording medium and a first substrate that supplies to the print head an electric signal that is used to control the print head;

a second substrate that is provided separate to the head unit, the second substrate supplying to the head unit an electric signal used to control the print head; and a support member that supports the head unit and the second substrate while allowing a positional relationship between the head unit and the second substrate to be changed between a first positional relationship in which the head unit and the second substrate are close to each other and a second positional relationship in which the head unit and the second substrate are away from each other, wherein the support member fully supports the head unit and the second substrate while in the first and second positional relationships, wherein while the head unit and the second substrate are in the first positional relationship and are supported by the support member, the head unit and the second substrate are connected together such that an electric signal supply path is formed from the second substrate to the head unit, and while the head unit and the second substrate are in the second positional relationship and are supported by the support member, the head unit and the second substrate are disconnected from each other and the head unit is dismountable from the support member.

2. The image recording device according to claim 1, wherein while the head unit and the second substrate are in the second positional relationship and are supported by the support member, the second substrate is dismountable from the support member.

3. The image recording device according to claim 1, wherein the support member includes a first support member that supports the head unit in a detachable manner, a second support member that supports the second substrate in a detachable manner, and a relative displacement mechanism that allows relative displacement between the first support member and the second support member, and relative displacement of the first support member and the second support member through the relative displacement mechanism allows the positional relationship between the head unit and the second substrate to be changed between the first positional relationship and the second positional relationship.

4. The image recording device according to claim 3, wherein the relative displacement mechanism includes a swing support member that supports the first support member and the second support member and that allows relative swinging between the first support member and the second support member.

5. The image recording device according to claim 4, wherein a mounting side is provided in the second support member while being supported by the swing support member, the mounting side being provided so as to extend in an extending direction that is orthogonal to the swinging direction in which the first support member and the second support member relatively swing, and a slit is formed in the mounting side from one edge of the mounting side in an orthogonal direction that is orthogonal to the extending direction towards the other edge side and up to an intermediate portion of the mounting side, such that the mounting side is divided into a plurality of mounting portions in the extending direction, the second substrate being mounted on each of the plurality of mounting portions.

6. The image recording device according to claim 5, further comprising, an attaching mechanism that mounts the second substrate on the mounting portion while allowing relative displacement between the mounting portion and the second substrate.

7. The image recording device according to claim 3, further comprising, a connector mechanism including a first connector that is provided in the head unit and a second connector provided in the second substrate, wherein relative displacement of the first support member and the second support member allows switching to be carried out between a state in which a connection between the first connector and the second connector is established such that the electric signal supply path from the second substrate to the head unit is formed and a state in which the connection between the first connector and the second connector is released.

8. The image recording device according to claim 1, further comprising, an engaging mechanism that suppresses relative displacement between the head unit and the second substrate that are supported by the support member and that are in the first positional relationship.

9. The image recording device according to claim 1, wherein the print head and the first substrate are electrically coupled together with a cable that is dismountable from at least either one of the print head and the first substrate.

10. The image recording device according to claim 1, wherein the second substrate includes an electric circuit that generates a control signal in accordance with various conditions under which the image recording is carried out, and the first substrate includes an electric circuit that generates, on the basis of the control signal generated in the second substrate, a driving signal for driving the print head.

11. The image recording device according to claim 1, wherein the second substrate includes an electric circuit that generates a control signal in accordance with various conditions under which the image recording is carried out and an electric circuit that generates, on the basis of the control signal, a driving signal for driving the print head, and the first substrate includes wiring that transmits the driving signal generated in the second substrate.

12. The image recording device according to claim 1, wherein the first substrate includes a plurality of single first substrates and the second substrate includes a plurality of single second substrates, wherein the print head includes a plurality of unit heads that are provided with a nozzle that ejects the liquid, the plurality of unit heads being grouped into a plurality of groups that are each made up of two or more unit heads, and each group being provided with a single first substrate of the plurality of single first substrates and a single second substrate of the plurality of single second substrates.

* * * * *